US006446831B1

(12) United States Patent
Smith et al.

(10) Patent No.: US 6,446,831 B1
(45) Date of Patent: Sep. 10, 2002

(54) SYSTEM FOR DISPENSING APRONS

(76) Inventors: Kathy Smith, 9617 S. Bell, Chicago, IL (US) 60643; Mary Ellen Wirtz, 9743 Leavitt, Chicago, IL (US) 60643

( * ) Notice: Subject to any disclaimer, the term of this patent is extended or adjusted under 35 U.S.C. 154(b) by 66 days.

(21) Appl. No.: 09/685,109

(22) Filed: Oct. 10, 2000

(51) Int. Cl.[7] ..... A47K 10/24
(52) U.S. Cl. ..... 221/48; 221/52
(58) Field of Search ..... 221/33, 45, 48, 221/50, 63; 225/56, 93, 106; 2/48, 51, 52

(56) References Cited

U.S. PATENT DOCUMENTS

| | | | | | |
|---|---|---|---|---|---|
| 1,153,909 | A | * | 9/1915 | Hanes | 2/51 |
| 2,224,746 | A | | 12/1940 | Richstein | |
| 2,465,286 | A | * | 3/1949 | Silver | 2/51 |
| 2,756,430 | A | | 7/1956 | West | |
| 2,763,867 | A | | 9/1956 | Chagnon | |
| 2,897,505 | A | * | 8/1959 | Lipscomb | 2/48 |
| 3,131,399 | A | | 5/1964 | Murphy et al. | |
| 3,415,157 | A | | 12/1968 | Marder et al. | |
| 3,685,653 | A | | 8/1972 | Garshelis | |
| 3,735,865 | A | | 5/1973 | Smith | |
| 3,793,644 | A | | 2/1974 | Kellner | |
| 3,945,048 | A | | 3/1976 | Shearer | |
| 4,215,432 | A | | 8/1980 | Smith | |
| 4,225,977 | A | | 10/1980 | Smith | |
| 4,288,877 | A | | 9/1981 | Klepfer | |
| 4,306,316 | A | | 12/1981 | Klepfer | |
| 4,330,888 | A | | 5/1982 | Klepfer | |
| 4,543,668 | A | | 10/1985 | Franklin | |
| 4,622,698 | A | | 11/1986 | Heyman et al. | |
| 4,884,299 | A | | 12/1989 | Rose | |
| 5,444,873 | A | | 8/1995 | Levin | |
| 5,530,968 | A | | 7/1996 | Crocket | |
| 5,740,552 | A | | 4/1998 | Smith | |
| 5,802,811 | A | * | 9/1998 | Danzig | 53/429 |
| 5,809,568 | A | | 9/1998 | Morris-Jones | |

* cited by examiner

*Primary Examiner*—Kenneth W. Noland
(74) *Attorney, Agent, or Firm*—Wood, Phillips, Katz, Clark & Mortimer

(57) ABSTRACT

An apron dispensing system including a container and first and second aprons each having a stored state and a usable state. The first and second aprons each consist of a sheet and at least one of a) a strap that is extendable around the neck of a wearer, b) a strap that is extendable around the torso of a wearer, and c) a strap that is extendable around at least one of a leg and an arm of the wearer to maintain the sheet in a protective covering position over a part of the wearer with the apron in the usable state. The first and second aprons are engageable, each with the other, and cooperate with each other and the container so that a) with the first and second aprons in the stored state in the container the first apron has an exposed portion that can be grasped to separate the first apron from the container by drawing the first apron substantially in a first direction in a first line and b) continuous movement of the first apron in the first direction in the first line causes the first apron to i) draw the second apron relative to the container so that an exposed portion of the second apron becomes accessible to be grasped to separate the second apron from the container and ii) fully separate from the second apron.

19 Claims, 2 Drawing Sheets

SYSTEM FOR DISPENSING APRONS

BACKGROUND OF THE INVENTION

1. Field of the Invention

This invention relates to aprons of the type that afford a protective shield to wearers and, more particularly, to a system wherein aprons can be serially removed from a container for use.

2. Bavkground Art

Aprons are used in a wide range of environments by both adults and children engaged in both professional and recreational activities. Aprons are commonly worn around the home to shield the wearer and the wearer's clothes during cooking, cleaning, painting, etc. In industry, aprons are commonly worn in labs and in any environment in which an individual is potentially exposed to foreign material, be it potentially dangerous or harmless. Children have likewise been common users of aprons, both at home and at school. At school, aprons may be appropriate in classes that involve working with materials that may stain clothing, among which are lab classes and art classes.

As people become busier both at home and work, speed and convenience often dictate their behavior. While aprons are often appropriate in many situations, the inconvenience associated with locating and donning an apron may cause individuals to proceed without the apron and gamble that they will not detrimentally expose themselves to any foreign matter. Those proceeding without a warranted apron may often be required to act more cautiously than normal to avoid unwanted contact with foreign material. This may compromise performance. In spite of this conscious effort to exercise care, damaging of clothing or, in a worst case, potentially dangerous contact with a harmful material, may result. This is particularly true in situations where individuals act spontaneously when situations arise unexpectedly that call for an apron. Rather than seek out an apron, the user commonly opts to proceed and face the risk of exposure without the apron.

In the interest of promoting use of aprons, purveyors of aprons have devised various systems for bulk dispensing of disposable aprons. As an example, U.S. Pat. No. 5,809,568 discloses aprons which are formed in a roll and which are joined, each to the other, along lines weakened by perforations. To prepare an apron for use, the user is required to unroll an apron and sever the connection between that apron and the next apron connected thereto in the same manner that one commonly separates large capacity plastic kitchen and yard bags from a roll. This is generally a two-handed operation which represents a significant enough inconvenience that it may deter someone from using an apron. Additionally, the need to weaken the connection between adjacent aprons by perforations may make this construction impractical for certain materials that are otherwise desirable for use in making aprons.

Designers of these types of systems commonly seek ways to encourage the practical use of aprons even for a simple, isolated task.

SUMMARY OF THE INVENTION

In one form, the invention is directed to an apron dispensing system including a container and first and second aprons each having a stored state and a usable state. The first and second aprons each consist of a sheet and at least one of a) a strap that is extendable around the neck of a wearer, b) a strap that is extendable around the torso of a wearer, and c) a strap that is extendable around at least one of a leg and an arm of a wearer to maintain the sheet in a protective covering position over a part of the wearer with the apron in the usable state. The first and second aprons are engageable, each with the other, and cooperate with each other and the container so that a) with the first and second aprons in the stored state in the container the first apron has an exposed portion that can be grasped to separate the first apron from the container by drawing the first apron substantially in a first direction in a first line and b) continuous movement of the first apron in the first direction in the first line causes the first apron to i) draw the second apron relative to the container so that an exposed portion of the second apron becomes accessible to be grasped to separate the second apron from the container and ii) fully separate from the second apron.

In one form, each of the first and second aprons is defined by a single piece of material.

In one form, the first and second aprons have intermeshed folds which cause the first and second aprons to releasably grip each other with a force that allows a) the first apron to draw the second apron relative to the container to a withdrawal position wherein the exposed portion of the second apron becomes accessible to be grasped and b) the first apron to fully separate from the second apron as an incident of the first apron being drawn by a user in the first direction in the first line.

In one form, the first apron is joined to the second apron by a frangible connecting portion which a) holds the first and second aprons together with a force that allows the first apron to draw the second apron relative to the container to a withdrawal position and b) ruptures to allow the first apron to fully separate from the second apron as an incident of the first apron being drawn by a user in the first direction in the first line.

In alternative forms, the first and second aprons may be joined by an adhesive or by cooperating connecting parts so as to operate as described above.

The first and/or second aprons may be made from one of plastic, paper, metal or a cloth material.

In one form, the container defines a storage space within which the first and second aprons reside with the first and second aprons in the stored state. The container has a removal opening through which the first and second aprons are drawn to remove the first and second aprons from the storage space. The removal opening and the first and second aprons are relatively dimensioned so that the first and second aprons must be squeezed through the removal opening to separate the first and second aprons from the container. The container thus provides resistance to removal of the first and second aprons from the storage space.

In one form, the first apron has a strap that is extendable around the neck of the wearer and a strap that is extendable around the torso of the wearer.

In one form, at least one of the straps includes first and second joinable parts.

In another form, the invention is directed to an apron dispensing system having a container with a removal opening and first and second aprons each having a storage state and a usable state. The first and second aprons each consist of a sheet and at least one of a) a strap that is extendable around the neck of a wearer, b) a strap that is extendable around the torso of a wearer, and c) a strap that is extendable around at least one of a leg and an arm of a wearer to maintain the sheet in a protective covering position over a part of the wearer with the apron in the usable state. The first and second aprons are placed in stacked relationship in the storage state in the container so that a) the first apron has a portion exposed at the removal opening that can be grasped to separate the first apron from the container by drawing the first apron substantially in a first direction in a first line and b) separation of the first apron from the container causes a portion of the second apron to be exposed at the removal opening to be grasped and drawn in the first direction in the first line to separate the second apron from the container.

In one form, the first and second aprons are releasably connected, each to the other in a manner that the first and second aprons can be separated by a force exerted on the first apron in the first line in the first direction.

DETAILED DESCRIPTION OF THE DRAWINGS

Figure 1:
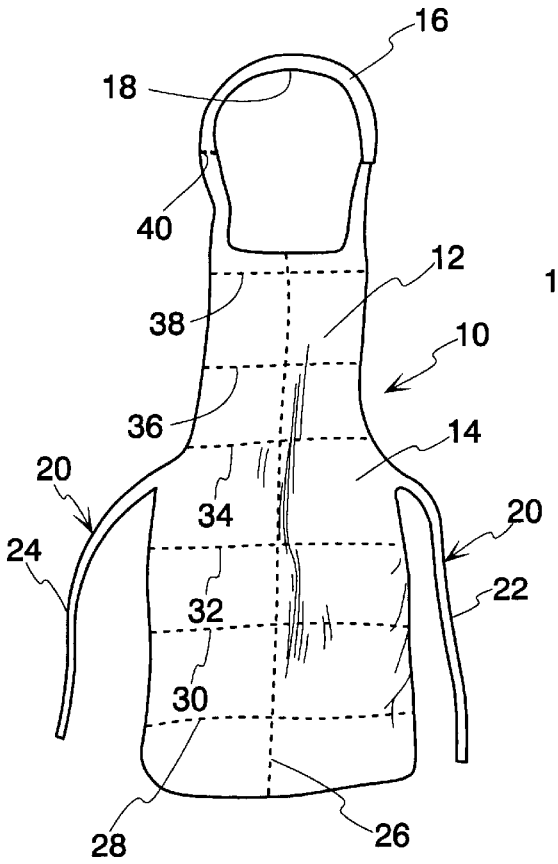
FIG. 1 is a front perspective view of one form of apron, that can be used according to the present invention, and with the apron in a usable state.

In FIG. 1, one form of apron, of the type usable according to the present invention, is shown at 10. The apron 10 is formed from a single sheet 12 of material, that may vary depending upon the particular application. The material may be, for example, one or a combination of plastic, paper, cloth, or metal film, etc. The sheet may be made from any material that is flexible and which can be placed in a desired protective covering position over a part of a wearer to perform a shielding function.

The apron 10 consists of a generally rectangular body 14 with a continuous strap 16 at one end thereof defining an opening 18 which receives the head of a wearer. The wearer's head can be directed through the opening 18 so that the apron 10 is suspended primarily by the neck of the wearer and so that the body 14 drapes downwardly over a substantial portion of the wearer's torso. A second strap 20, consisting of joinable strap parts 22, 24, is provided at a midportion of the body 14. The strap parts 22, 24 can be directed around the wearer's torso and tied to firmly hold the apron 10 in place.

Figure 2:
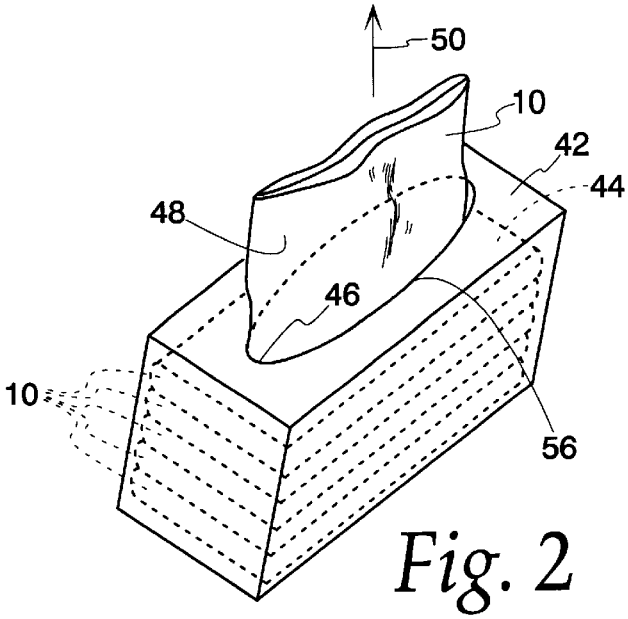
FIG. 2 is a perspective view of a container in which a plurality of aprons, as in FIG. 1, are placed in a folded state, for removal, one by one, from the container.

The apron 10 is shown in FIG. 1 in a usable state. According to the invention, the apron 10 is placeable in a storage state, as shown in FIG. 2, by folding. One exemplary folding pattern can be achieved by folding the apron 10 first about a vertical fold line 26 and then folding the doubled-over apron 10 successively about fold lines 28, 30, 32, 34, 36, 38, 40 to produce a compacted, generally squared configuration. The strap parts 22, 24 can be tucked against the body 14 at the initiation of folding. The particular folding pattern is not critical to the present invention and may vary considerably from that shown.

In the storage folded state, the aprons 10 can be stacked within a container 42, as shown in FIG. 2. The container 42 has a generally squared shape with an internal storage space 44 for reception of a plurality of the folded aprons 10, and a removal opening 46 through which the aprons 10 can be removed, one by one, from the storage space 44 for use.

In one form, the aprons 10, in the stored state, are stacked one atop the other so that the topmost apron 10 has a portion 48 that is exposed at the removal opening 46 so as to be graspable by a user to draw the apron 10 outwardly to a fully separated state. The removal action is carried out by drawing the apron 10 vertically upwardly in a line indicated by the arrow 50. Upon fully separating the uppermost apron 10, the underlying apron 10 has a portion exposed at the opening 46 to be grasped for removal of its associated apron 10 in a like manner.

Figure 3:
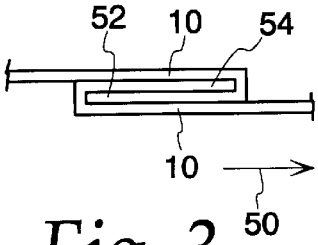
FIG. 3 is an enlarged, fragmentary, side elevation view of a releasable connection between leading and trailing aprons in the form of intermeshed folds which allows the leading apron to draw, and eventually release from, the trailing apron.

To facilitate serial removal of the aprons 10, the aprons 10 may be interconnected so that the removal of one apron causes the one apron to draw the next apron up to a more accessible position to be grasped. As shown in FIG. 3, the interconnection may be accomplished by intermeshed folding. In this embodiment, the trailing edge 52 of one of the aprons 10 in the stored state is folded against itself. The leading edge 54 of an adjacent apron 10 is likewise folded against itself. The folded edges 52, 54 are interlocked. By exerting a force on the leading apron 10 in the direction of the arrow 50, the intermeshed folds cause the leading apron 10 to draw the trailing apron therewith. Continued application of the force in the direction of the arrow 50 eventually causes the leading apron to be drawn out of the removal opening 46. Separation of the aprons occurs, leaving the edge 52 exposed to be grasped for withdrawing the following apron.

The interlocked folding can be designed to release the aprons 10 in a number of different manners. In one form, the removal opening 46 is configured so that the aprons 10 must be squeezed to be drawn therethrough. Accordingly, the container edge 56 produces a substantial resistant force on the aprons 10, due to the friction between the edge 56 and the aprons 10. As a result, a greater force must be applied in the direction of the arrow 50 than would otherwise be required to advance the aprons 10 in the event that there was no resistance to the aprons 10 being drawn through the removal opening 46. The folding pattern can be such as to release the aprons 10 as the trailing edge 52 and leading edge 54 either near the removal opening 46 but reside within the storage space 44, or upon the trailing edge 52 and leading edge 54 clearing the removal opening 46. In the former case, the trailing edge 52 is accessible through the removal opening 46, whereas in the latter case, the trailing edge 52 projects from the removal opening 46 to be readily grasped for removal. The particular intermeshed folding arrangement can vary considerably from that shown to either increase or decrease the holding force between joined aprons.

Figure 4:
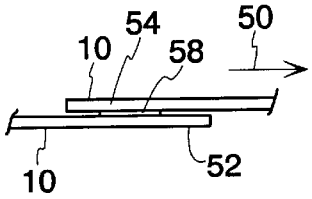
FIG. 4 is a view as in FIG. 3 showing a modified form of connection between leading and trailing aprons consisting of an adhesive layer.

As an alternative to the frictional engagement between the intermeshed folds of adjacent aprons 10 in FIG. 3, an adhesive can be used, as shown in FIG. 4. More specifically, an adhesive layer 58 is interposed between the trailing and leading edges 52, 54 of adjacent aprons 10. The adhesive layer 58 could be provided as cooperating adhesive components on each of the edges 52, 54. Alternatively, the adhesive layer could be provided on only one of the edges 52, 54. The tenacity of the adhesive in the layer 58 is chosen to release with the leading apron being drawn in the direction of the arrow 50, either with the trailing edge 52 drawn out of the removal opening 46 or located to be readily accessible through the removal opening 46.

Figure 5:
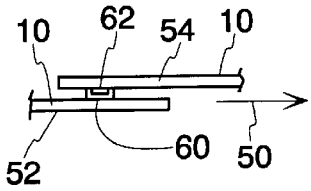
FIG. 5 is a view as in FIGS. 3 and 4 of a further modified form of connection between leading and trailing aprons and consisting of separable connector parts.

As a still further alternative, as shown in FIG. 5, cooperating, releasable connector parts 60, 62 can be provided on the trailing and leading edges 52, 54 of the connected aprons 10. The connector parts 60, 62 can be any type of well-known connector, such as a snap-fit connector which is designed to release as an incident of a force being applied in the direction of the arrow 50 in response to withdrawal of the leading apron 10, hook and loop fastener, etc.

Figure 7:
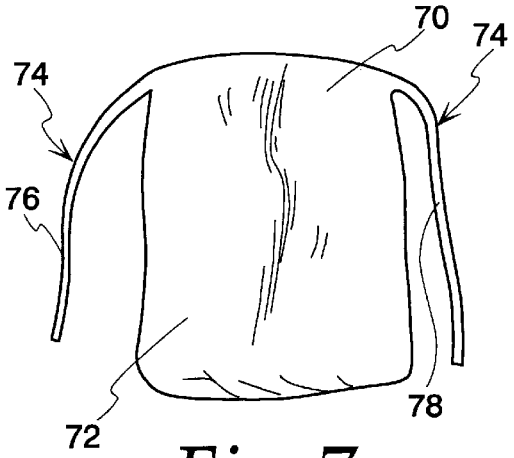
FIG. 7 is a front elevation view of one of the aprons in FIG. 6 in a usable state.
Figure 6:
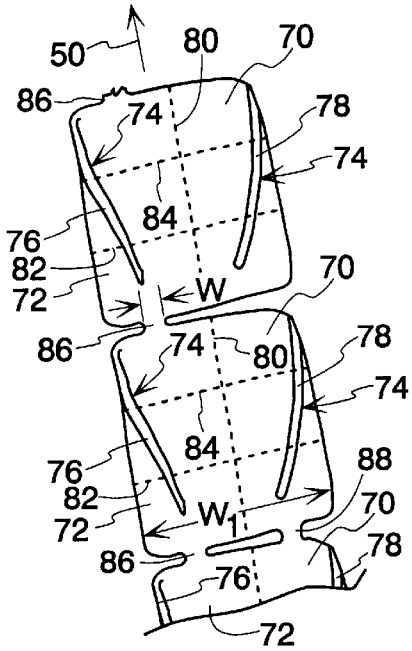
FIG. 6 is a fragmentary, front elevation view of a plurality of aprons in a usable state, modified from the configuration shown in FIG. 1 and connected releasably through frangible portions which allow a leading apron to draw a trailing apron, and which eventually rupture to separate the leading apron from the trailing apron.

A still further embodiment is shown in FIGS. 6 and 7 on a modified form of apron 70. The apron 70 consists of a generally squared body 72 with a strap 74 designed to wrap around the waist of a wearer to maintain the body 72 in a depending state. The strap 74 consists of joinable strap parts 76, 78 which can be conventionally tied together to maintain the apron 70 in place.

The aprons 70 are shown in a usable state in FIGS. 6 and 7 and are foldable to a stored state in a manner similar to that described above for the apron 10. That is, the bodies 72 can be folded in half about a vertical fold line 80 with the strap parts 76, 78 tucked therebetween and thereafter folded about horizontal fold lines 82, 84 to produce a compact stored configuration which can be stacked in a container such as the container 42, described above.

The aprons 70 can be interconnected as described for the apron 10 in FIGS. 3-5. Alternatively, the aprons 70 can be interconnected by frangible portions 86 which rupture in response to the application of a force in the direction of the arrow 50 which withdraws the aprons 70 from the container 42. The frangible portions 86 have a width W that is substantially less than the width WI of the body 72. In this case, the width W of the frangible portion 86 is on the order of one-eighth the overall width W1. The width W can be selected depending upon the force magnitude applied along the arrow 50 that is desired to cause rupture thereof. Again, the design can be selected so that the rupture occurs under the application of force in the direction of the arrow 50 with the trailing apron 70 either drawn partially through the removal opening 46 or exposed thereat within the storage space 44. Additional frangible portions 88 may be utilized to control the separation characteristics.

The inventive concept is not limited to the apron configuration shown in FIGS. 1-7. There are virtually an infinite number of different configurations for aprons that can be employed utilizing the present invention. Various alternative examples, which are not inclusive of all designs contemplated, are shown in FIGS. 8-11. Each of the embodiments of FIGS. 8-11 can be stored in a container such as the container 42 in FIG. 2 for serial release thereof, and can be interconnected as described in each of the embodiments in FIGS. 1-7.

Figure 8:
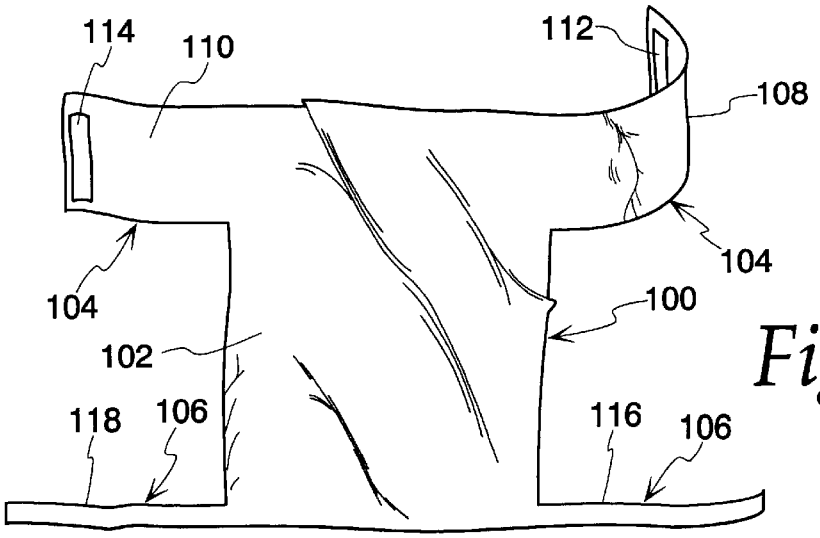
FIG. 8 is a front elevation view of a further modified form of apron shown in the usable state.

In FIG. 8, an apron is shown at 100 with a generally squared body 102 having an upper, thick strap 104 and a lower, thinner strap 106. The strap 104 consists of strap parts 108, 110 which can be wrapped around the torso of a user. The strap parts 108, 110 can be joined through the use of hook and loop type fastener including joinable hook and loop parts 112, 114 attached thereto. The strap 106 consists of strap parts 116, 118 which can be tied around the waist of a user.

Figure 9:
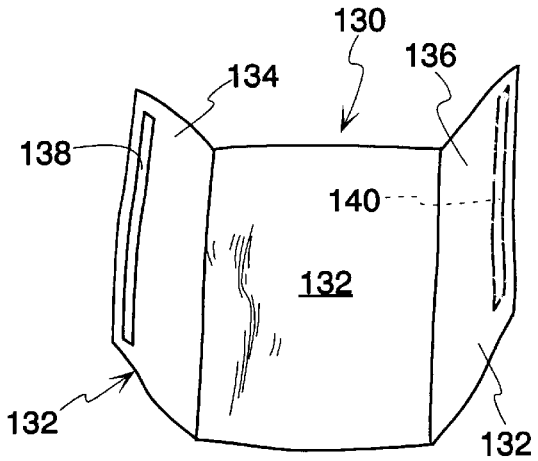
FIG. 9 is a front elevation view of another modified form of apron in a usable state.

In FIG. 9, an apron is shown at 130 consisting of a squared body 132 with a single thick strap 132 consisting of joinable strap portions 134, 136 which have a vertical dimension substantially equal to that of the body 132. The strap parts 134 and 136 can be wrapped around a wearer's torso and joined to each other by cooperating connectors, which may be hook and loop type fasteners including mating parts 138, 140.

Figure 10:
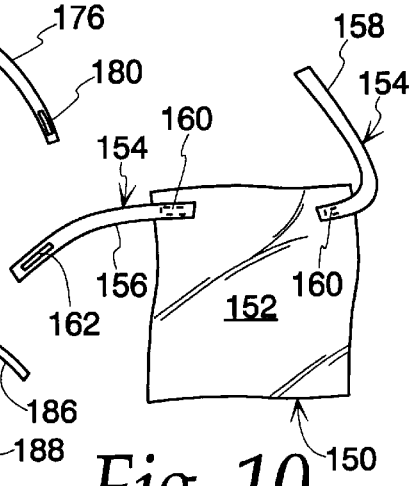
FIG. 10 is a front elevation view of a further modified form of apron in a usable state.

In FIG. 10, an apron is shown at 150 consisting of a squared body 152 with a strap 154 consisting of joinable strap parts 156, 158. The strap parts 156, 158 are elements separate from the body 152 and joined thereto as by stitching 160. To facilitating connection of the strap parts 156, 158 to each other, a slit 162 is provided in the one strap part 156 which allows direction of the other strap part 158 therethrough to effect frictional gripping thereof. Alternatively, the strap parts 156, 158 can be tied as previously described.

Figure 11:
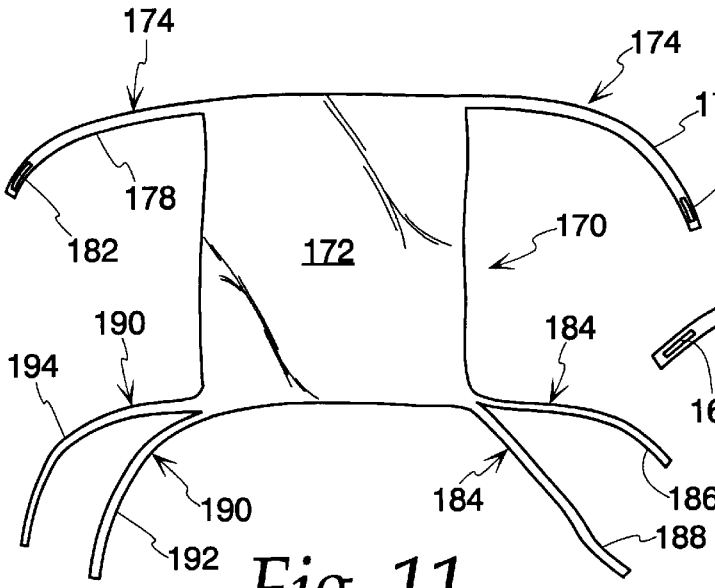
FIG. 11 is a front elevation view of a still further modified form of apron in a usable state.

In FIG. 11, an apron is shown at 170 consisting of a body 172 with one strap 174 consisting of joinable strap parts 176, 178 that can be wrapped around the torso of a wearer and secured, as by tying. Alternatively, the strap parts 176, 178 can be joined to each other through the use of hook and loop type fastener, or other type of connector, including mating parts 180, 182.

A separate strap is shown at 184 and consists of joinable strap parts 186, 188 which can be tied to each other around either an arm or a leg, depending upon the vertical orientation of the apron 170. A strap 190, consisting of joinable strap parts 192, 194, is provided opposite to the strap 184 and functions in the same manner, as to wrap around an arm or leg of a wearer.

All of the apron embodiments disclosed can be stacked in a stored state for serial release thereof. While not absolutely necessary, a container 42 is desirable to maintain the stack of the aprons in a stored space for convenient separation thereof.

The various aprons disclosed can be made for either adults or children. The straps can be made of a length to accommodate a range of different girths, with the height being selected depending upon the desired area of coverage.

The foregoing disclosure of specific embodiments is intended to be illustrative of the broad concepts comprehended by the invention.

We claim:

1. An apron dispensing system comprising:

a container; and first and second aprons each having a stored state and a usable state, the first and second aprons each comprising a sheet and at least one of a) a strap that is extendable around the neck of a wearer, b) a strap that is extendable around the torso of a wearer and, c) a strap that is extendable around at least one of a leg and an arm of a wearer to maintain the sheet in a protective covering position over a part of wearer with the apron in a usable state, the first and second aprons being engageable each with the other and cooperating with each other and the container so that a) with the first and second aprons in the stored state in the container the first apron has an exposed portion that can be grasped to separate the first apron from the container by drawing the first apron substantially in a first direction and in a first line, and b) continuous movement of the first apron in the first direction in the first line causes the first apron to i) draw the second apron relative to the container so that an exposed portion of the second apron becomes accessible to be grasped to separate the second apron from the container and ii) fully separate from the second apron.

2. The apron dispensing system according to claim 1 wherein each of the first and second aprons is defined by a single piece of material.

3. The apron dispensing system according to claim 1 wherein the first and second aprons have intermeshed folds which cause the first and second aprons to releasably grip each other with a force that allows a) the first apron to draw the second apron relative to the container to a withdrawal position wherein the exposed portion of the second apron becomes accessible to be grasped and b) the first apron to fully separate from the second apron as an incident of the first apron being drawn by a user in the first direction in the first line.

4. The apron dispensing system according to claim 1 wherein the first apron is joined to the second apron by a frangible connecting portion which a)holds the first and second aprons together with a force that allows the first apron to draw the second apron relative to the container to a withdrawal position wherein the exposed portion of the second apron becomes accessible to be grasped and b) ruptures to allow the first apron to be fully separated from the second apron as an incident of the first apron being drawn by a user in the first direction in the first line.

5. The apron dispensing system according to claim 1 wherein the first apron is joined to the second apron by an adhesive which a) holds the first and second aprons together with a force that allows the first apron to draw the second apron relative to the container to a withdrawal position wherein the exposed portion of the second apron becomes accessible to be grasped and b) releases to allow the first apron to be fully separated from the second apron as an incident of the first apron being drawn by a user in the first direction in the first line.

6. The apron dispensing system according to claim 1 wherein the first apron is joined to the second apron by releasable cooperating connector parts on the first and second apron which a) hold the first and second aprons together with a force that allows the first apron to draw the second apron relative to the container to a withdrawal position wherein the exposed portion of the second apron becomes accessible to be grasped and b) release from each other to allow the first apron to be fully separated from the second apron as an incident of the first apron being drawn by a user in the first direction in the first line.

7. The apron dispensing system according to claim 1 wherein the first apron comprises plastic.

8. The apron dispensing system according to claim 1 wherein the first apron comprises paper.

9. The apron dispensing system according to claim 1 wherein the first apron comprises a cloth material.

10. The apron dispensing system according to claim 1 wherein the container defines a storage space within which the first and second aprons reside with the first and second aprons in the stored state, the container has a removal opening through which the first and second aprons are drawn to remove the first and second aprons from the storage space, and the removal opening and first and second aprons are relatively dimensioned so that the first and second aprons must be squeezed through the removal opening to separate the first and second aprons from the container such that the container provides resistance to removal of the first and second aprons from the storage space.

11. The apron dispensing system according to claim 1 wherein the first apron comprises a strap that is extendable around the neck of a wearer and a strap that is extendable around the torso of a wearer.

12. The apron dispensing system according to claim 1 wherein at least one of the straps comprises first and second joinable strap parts.

13. An apron dispensing system comprising:

a container having a removal opening; and first and second aprons each having a stored state and a usable state, the first and second aprons each comprising a sheet and at least one of a) a strap that is extendable around the neck of a wearer, b) a strap that is extendable around the torso of a wearer and, c) a strap that is extendable around at least one of a leg and an arm of a wearer to maintain the sheet in a protective covering position over a part of a wearer with the apron in a usable state, the first and second aprons placed in stacked relationship in the stored state in the container so that a) the first apron has a portion exposed at the removal opening that can be grasped to separate the first apron from the container by drawing the first apron substantially in a first direction in a first line, and b) separation of the first apron from the container causes a portion of the second apron to be exposed at the removal opening which can be grasped and drawn in the first direction in the first line to separate the second apron from the container, wherein the first and second aprons are releasably connected, each to the other, in a manner that the first and second aprons can be separated, each from the other, by a force exerted on the first apron in the first line in the first direction.

14. The apron dispensing system according to claim 13 wherein the first apron is defined by a single piece of material.

15. The apron dispensing system according to claim 13 wherein the first apron comprises at least one of plastic, paper, cloth, and metal.

16. An apron dispensing system comprising:

a container having a removal opening; and first and second aprons each having a stored state and a usable state, the first and second aprons each comprising a sheet and at least one of a) a strap that is extendable around the neck of a wearer, b) a strap that is extendable around the torso of a wearer and, c) a strap that is extendable around at least one of a leg and an arm of a wearer to maintain the sheet in a protective covering position over a part of a wearer with the apron in a usable state, the first and second aprons placed in stacked relationship in the stored state in the container so that a) the first apron has a portion exposed at the removal opening that can be grasped to separate the first apron from the container by drawing the first apron substantially in a first direction in a first line, and b) separation of the first apron from the container causes a portion of the second apron to be exposed at the removal opening which can be grasped and drawn in the first direction in the first line to separate the second apron from the container, wherein the first and second aprons are releasably connected by cooperating connecting parts, one each on the first and second apron.

17. An apron dispensing system comprising:

a container having a removal opening; and first and second aprons each having a stored state and a usable state, the first and second aprons each comprising a sheet and at least one of a) a strap that is extendable around the neck of a wearer, b) a strap that is extendable around the torso of a wearer and, c) a strap that is extendable around at least one of a leg and an arm of a wearer to maintain the sheet in a protective covering position over a part of a wearer with the apron in a usable state, the first and second aprons placed in stacked relationship in the stored state in the container so that a) the first apron has a portion exposed at the removal opening that can be grasped to separate the first apron from the container by drawing the first apron substantially in a first direction in a first line, and b) separation of the first apron from the container causes a portion of the second apron to be exposed at the removal opening which can be grasped and drawn in the first direction in the first line to separate the second apron from the container, wherein the first and second aprons are releasably connected by an adhesive.

18. An apron dispensing system comprising:

a container having a removal opening; and first and second aprons each having a stored state and a usable state, the first and second aprons each comprising a sheet and at least one of a) a strap that is extendable around the neck of a wearer, b) a strap that is extendable around the torso of a wearer and, c) a strap that is extendable around at least one of a leg and an arm of a wearer to maintain the sheet in a protective covering position over a part of a wearer with the apron in a usable state, the first and second aprons placed in stacked relationship in the stored state in the container so that a) the first apron has a portion exposed at the removal opening that can be grasped to separate the first apron from the container by drawing the first apron substantially in a first direction in a first line, and b) separation of the first apron from the container causes a portion of the second apron to be exposed at the removal opening which can be grasped and drawn in the first direction in the first line to separate the second apron from the container, wherein the first and second aprons are releasably connected through intermeshed folding.

19. An apron dispensing system comprising:

a container having a removal opening; and first and second aprons each having a stored state and a usable state, the first and second aprons each comprising a sheet and at least one of a) a strap that is extendable around the neck of a wearer, b) a strap that is extendable around the torso of a wearer and, c) a strap that is extendable around at least one of a leg and an arm of a wearer to maintain the sheet in a protective covering position over a part of a wearer with the apron in a usable state, the first and second aprons placed in stacked relationship in the stored state in the container so that a) the first apron has a portion exposed at the removal opening that can be grasped to separate the first apron from the container by drawing the first apron substantially in a first direction in a first line, and b) separation of the first apron from the container causes a portion of the second apron to be exposed at the removal opening which can be grasped and drawn in the first direction in the first line to separate the second apron from the container, wherein the first and second aprons are releasably connected by a frangible portion.

* * * * *